United States Patent [19]

Vogelsberg

[11] 4,288,976

[45] Sep. 15, 1981

[54] APPARATUS FOR THE SZ-TWISTING OF POWER CABLE CONDUCTORS WITH SECTOR-SHAPED CONDUCTOR CROSS SECTION

[75] Inventor: Dieter Vogelsberg, Coburg, Fed. Rep. of Germany

[73] Assignee: Siemens Aktiengesellschaft, Berlin and Munich, Fed. Rep. of Germany

[21] Appl. No.: 59,195

[22] Filed: Jul. 20, 1979

[30] Foreign Application Priority Data

Jul. 28, 1978 [DE] Fed. Rep. of Germany ..... 2833703

[51] Int. Cl.[3] ..... H01B 13/04

[52] U.S. Cl. ..... 57/293

[58] Field of Search ..... 57/293, 294

[56] References Cited

U.S. PATENT DOCUMENTS

| | | | |
|---|---|---|---|
| 3,481,127 | 12/1969 | Vogelsberg | 57/294 |
| 3,491,525 | 1/1970 | Sugi | 57/294 |
| 3,507,108 | 4/1970 | Yoshimura et al. | 57/294 |
| 3,593,509 | 7/1971 | Feese et al. | 57/293 |
| 3,823,536 | 7/1974 | Vogelsberg et al. | 57/294 |
| 3,884,025 | 5/1975 | Oberender et al. | 57/293 |
| 4,171,609 | 10/1979 | Feese | 57/293 |

FOREIGN PATENT DOCUMENTS

| | | |
|---|---|---|
| 1790249 | 4/1972 | Fed. Rep. of Germany . |
| 2211111 | 9/1973 | Fed. Rep. of Germany . |
| 2412199 | 9/1975 | Fed. Rep. of Germany . |
| 2514033 | 10/1976 | Fed. Rep. of Germany . |

*Primary Examiner*—John Petrakes

*Attorney, Agent, or Firm*—Kenyon & Kenyon

[57] ABSTRACT

For the SZ twisting of cable conductors with a sector-shaped conductor cross section which are not pre-twisted, stationary control guides for the conductors are provided and a twisting device is disposed immediately after the twisting closer with the distance between the engagement point of each control guide at a cable conductor and the first point of engagement with the material to be twisted of the twisting device tensionally gripping the material to be twisted from the outside made smaller than or at most equal to the length of lay of the material to be twisted. In addition, the free distance between the twisting device and the nearest device gripping the material to be twisted in a torsion-proof manner is very much larger than the length by which a longitudinal section of the twisted material is advanced during an interval of constant direction of rotation of the twisting device.

6 Claims, 4 Drawing Figures

APPARATUS FOR THE SZ-TWISTING OF POWER CABLE CONDUCTORS WITH SECTOR-SHAPED CONDUCTOR CROSS SECTION

BACKGROUND OF THE INVENTION

This invention relates to the manufacturing of electric cables in general and more particularly to the SZ twisting of power cable conductors with a sector-shaped conductor cross section, taking into consideration particularly the mechanical forces occuring in this process.

For better space utilization of the cable cross section, it is customary to use cable conductors with sector-shaped conductor cross section in multiconductor power cables in the low and lower-medium voltage range (below 10 kV). The conductors are twisted together with a constant direction of twist to form the cable core. Sector conductors with and without a preliminary twist can be used. Sector conductors without a preliminary twist are twisted together without untwisting; strong torsional stresses then act on the sector conductors during the twisting process. Sector conductors with a preliminary twist are twisted together with back twist. In that case, the torsional stresses are relatively low ("Kabel-und Leitungsfertigung," Kombinat VEB Kablewerk Oberspree, VEB-Verlag Technik Berlin, 1976, page 200). In the twisting of sector conductors, it is customary to arrange forced guidance for each conductor ahead of the twisting process. Such forced guidance may consist of several profiled pulleys which are arranged in a straight line, one behind the other, and between which the respective conductors pass (DE-OS No. 22 11 111).

Besides the conventional twisting of the sector conductors with a uniform direction of twist, a type of twisting is also known, in which the sector conductors are twisted with a direction of twist which changes at intervals. Such a type of twisting, which is called "SZ twisting" has found acceptance in recent years in the manufacture of communication and power cables. However, the SZ twisting machines developed for this purpose cannot be used directly, without further development, for the twisting of sector conductors, since large mechanical forces must be controlled in the twisting of sector conductors because of the large conductor cross sections (more than 35 $mm^2$).

In known apparatus for SZ twisting without preliminary twist, an oscillating lay plate arranged ahead of a twisting closer is coupled to the control guides for the sector conductors. With such a twisting device, only one or two twist lays per twist direction can naturally be generated (DE-OX No. 25 14 033). It has furthermore been previously proposed to twist the sector conductors which are straightened ahead of the twisting closer, by means of a twisting device arranged between a first and a second twisting closer. This device rotates with a direction of rotation which changes at intervals, so that the sector conductors are twisted for a first time in the first twisting closer and a second time in the same direction in the second twisting closer. The twisting device consists of one or two collet pulls in tandem. Optionally, non-rotating collet pulls can be arranged between the twisting points and the twisting device in order to always ensure the same distances between the controlling stationary and rotating parts of the twisting device, so as to obtain equal length of lay. The direction of rotation of the twisting device is changed at intervals which are matched in a manner known per se to the storage capacity of the apparatus. (DE-OS No. 27 42 662)

For SZ twisting round conductors with a larger conductor cross section, an SZ twisting machine is also known which contains two twisting tools, namely, an oscillating holeplate and a twisting head which rotates in an oscillating manner in the form of a caterpillar pull or a three-pulley device. While the hole plate is arranged in front of a first twisting closer, the twisting head is located between the first and a second twisting closer. (DE-OS No. 24 12 199).

There is further known a twisting method for the SZ twisting of base groups of communication cables, in which the elements to be twisted are fed to a twisting closer via a hole plate, are twisted immediately thereupon by means of an oscillating twisting head and are subsequently conducted unsupported in air, over a distance which is much longer than the distance of the reversal points of the twist direction in the twisted material. By application of a wrapping during the twisting process, the reversal points of the twist direction are prevented from untwisting while the material is freely conducted through the air (Wire and Wire Products, 1967, page 96). For such twisting purposes, twisting heads can also be used which are designed in the manner of a caterpillar pull (DE-OS No. 17 90 249) or consist of a deflection pulley which is arranged tangentially to the twisting axis and around which the material to be twisted is looped once (DE-AS No. 17 65 453).

SUMMARY OF THE INVENTION

It is an object of the present invention to design apparatus for the SZ twisting of power cable conductors with sector-shaped conductor cross section which are not pre-twisted, in such a manner that at least three twist lays can be applied in each direction of twist and that the twisting leads to To solve this problem, the present invention starts out from apparatus which includes stationary conductor supplies, a twisting closer or twisting point with a control guide for each conductor arranged ahead of the closer, a twisting device rotating with changing direction of rotation, and a pull-off and wind-up device arranged after the twisting device. According to the present invention, the control guides are stationary and the twisting device is arranged immediately behind the twisting point; the distance between the last point of engagement of each control guide at a cable conductor and the first point of engagement with the material to be twisted by the twisting device gripping the material to be twisted tensionally from the outside is smaller than, or at most equal to, the length of lay of the material to be twisted as is given by the pull-off velocity and the speed of rotation of the twisting device, preferably smaller than, or at most equal to, one-half the length of lay. Furthermore, the free distance between the twisting device and the nearest device gripping the material to be twisted in a torsion proof manner in the circumferential direction (for instance, the pull-off device or a deflection device) is very much longer than the length by which a longitudinal section of the material to be twisted is advanced during an interval of uniform direction of rotation of the twisting device.

With apparatus designed in this manner, the cable conductors are effectively twisted together over a short distance, the lengths of the points of changing torsion being matched to the length of the twist reversal points of the cable conductors which are twisted together. In this respect, the present invention is based, among other things, on the consideration that the torsioning of the cable conductors which are not pre-twisted and the formation of the torsion change points as well as of the twist change points are accomplished over a distance which is kept as short as possible, and the forces required for this purpose should attack not only at the outer surface of the cable conductors united to form a strand but also at the individual cable conductors themselves as long as the latter are not yet twisted. The distance, which is kept as short as possible, should in no case be longer than one length of lay of the twisted cable conductors. In view of the lengths of lay customary with sector conductor cables, which are in the order of about 150 cm, this means that the distance between the control guides and the twisting device should be 60 to 100 cm, if possible.

Otherwise, because of the free distance between the twisting device and the nearest device gripping the material to be twisted in a torsion proof manner, the cable conductors will become permanently torsioned or twisted only once, and specifically, on the path from the twisting closer to the twisting device. By using a twisting device which grips the material to be twisted tensionally from the outside, i.e., a twisting head, it is ensured that the cable conductors can be twisted with a larger number of twist lays in each twist direction.

To develop a clean twisting geometry, the rotating twisting head and the control guides for the cable conductors should furthermore be arranged close together in space, as already mentioned. In that case, the flow of force goes from the rotating twisting head via the material to be twisted to the control guides through paths which are relatively closely limited in space. So that no damage to the conductors can occur, the dimensions of the individual machine parts must be designed carefully. So that the control guides can be arranged as close as possible near the twisting closer, an embodiment in the form of several profiled guide rollers which are arranged along a wavy line, always on the inside of the wavy line, is therefore advisable. Some of the guide rollers arranged on both sides of the wavy line can be opposite each other in pairs of in the gaps, especially in a zone where the wavy line changes its curvature. With such a design of the control guide, the longitudinal forces active when the cable conductors are pulled off are transformed into transversal force.

Particularly large forces can be taken up by a control guide if the latter consists of two deflection pulleys arranged in tandem, on which the respective cable conductor is in contact with a looping angle of at least 90°. Such deflection pulleys provided with a profiled groove permit a particularly gentle treatment of the sector-shaped cable conductors. In this connection, in order to avoid an excessively long distance between the last deflection pulley and the twisting closer, this distance can be bridged by one or more profiled guide rollers; these guide rollers are advantageously arranged along a curved line, so that the respective cable conductor can be pressed against these profiled rollers through transformation of longitudinal forces into transversal forces.

The twisting head arranged behind the twisting closer must also be designed appropriately in view of transmitting forces as large as possible as well as in view of an arrangement as close to the twisting closer as possible. Suitable for this purpose are caterpillar arrangements of the gripping jaw or collet devices. Especially advantageous with respect to a gentle treatment of the material to be twisted, however, is the use of a single pulley twister, in which the twisting head consists of a deflection pulley over which the material to be twisted is looped once and which is arranged approximately symmetrically to the twisting axis. Since the material to be twisted is deflected in this case out of the twisting axis, very large torsion forces can be transmitted to the material to be twisted, utilizing the lever action. So as to place the engagement points of this twisting head as close as possible to the twisting closer, it is then necessary to assign one or more guide rollers to each deflection pulley for feeding and removing the material to be twisted.

DETAILED DESCRIPTION OF THE INVENTION

The apparatus schematically shown in the figures consists essentially of design elements which are familiar to those skilled in the art such as reels, hole plates, deflection rollers, control guides, twisting closers, twisting heads, caterpillar tracks or collet pull off devices, extruders, water cooling sections, pull-off and wind-up devices. The detailed mechanical design of these components is therefore not depicted.

Figure 1:
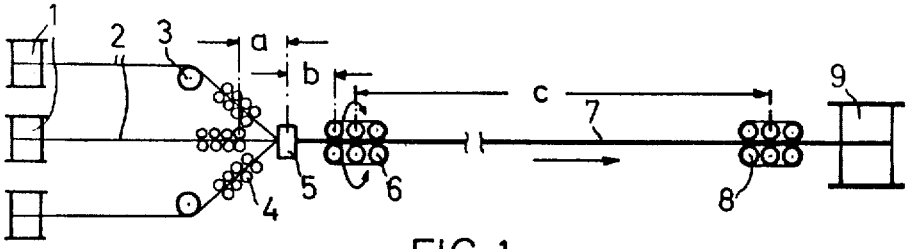
FIG. 1 is a schematic diagram of twisting apparatus according to the present invention.

The apparatus shown in FIG. 1 is used for twisting three power cable conductors 2 to form a stranded assembly 7. The plastic insulated cable conductors 2 have a sector-shaped conductor cross section and are not pre-twisted. They run off from stationary conductor supplies 1 and are fed to the twisting closer 5 via deflection rollers 3 and control guides 4.

Behind the twisting closer 5, a twisting head 6 is arranged, which rotates with a changing direction of rotation and grips the cable conductors brought together in the twisting closer 5 tensionally from the outside and torsions or twists them together. The twisting head consists of a caterpillar track arrangement or of an arrangement in the manner of a collet pulling device. The caterpillar tracks or collets are normally driven by the material to be twisted which passes through with a constant pull-off velocity v in the direction of the twisting axis, but can also be driven from the outside and move the material to be twisted in the lengthwise direction of the twisting axis. The rotary motion of the twisting head 6, i.e., its speed or direction, is changed at certain intervals. Following the twisting head 6, the cable conductors torsioned with each other pass over a distance of length c free in the air and then are gripped by the pull-off device 8 and are wound onto the take-up device 9. The length of the conducted distance c is chosen very much larger than the length of a section of the twisted material with uniform direction of lay. "Very much larger" means at least four times larger, and preferably five to eight times this length of a section.

The free distance c provided between the twisting head 6 and the pull-off device 8 assures that the torsion exerted, on the material to be twisted behind the twisting head 6, does not lead to a permanent torsioning of the material to be twisted because the alternatingly superposed additional twist in the region of this distance is equalized or taken up elastically by the twisted assembly, and thus does not disturb the geometry of the twisted assembly. An additional elastic twist that might occur is cancelled in the following operations, in which the twisted assembly is conducted over long distances free in the air. The permanent twist of the cable conductors 2 is therefore achieved by the twist exerted by the twisting head 6 in the vicinity of the twisting closer 5 alone.

In the region of the distance c between the twisting head 6 and the pull-off device 8, untwisting of the reversal points of the twist direction of the material to be twisted under the influence of tensil forces is not expected, since the cable conductors 2 are plastically deformed in the vicinity of the reversal points and therefore provide a stable twist geometry. Optionally, however, a tape spinner can be provided after the twisting head 6, by which a holding helix is applied on the twisted assembly 7. Incidentally, the pull-off device 8 can be dispensed with if the alternatingly rotating twisting head 6 takes over its function.

The effective distance of the twisting head 6 from the twisting closer 5 is designated as b and the effective distance of the control guides 4 from the twisting closer 5 as a. The sum of the distances a and b should be smaller than one length of lay of the twisted material.

In the device shown in FIG. 1, the control guides 4 consist of groups of rollers disposed opposite each other in pairs; the individual rollers have profiles and these profiles are matched exactly to the shape of the cross section of the sector conductors 2. The profiles and the contact pressure between the groups of rollers prevent the sector conductors 2 from turning in the region of the control guides 4. The lengthwise movement of the sector conductors is not impeded.

Figure 2:
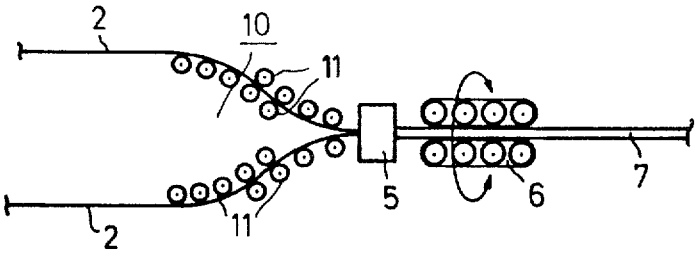
FIG. 2 illustrates a further embodiment of positive guides which can be used with the apparatus of FIG. 1.

In FIG. 2, control guides 10 which also consist of profiled deflection rollers 11 are shown. These deflection rollers, however, are arranged along a wavy line, especially an S-shaped line, so that, due to the deflection of the cable conductors obtained thereby, the longitudinal forces effective as a result of the pulling-off motion are transformed into transversal forces. Special pressure of the profiled rollers 11 onto the cable conductors is therefore not necessary. In the region where the curvature of the wavy line changes, the deflection rollers are arranged opposite each other or in the gaps. The advantage of such an arrangement is seen in the fact that a particularly small distance between the last guide roller of a control guide 10 and the twisting closer 5 can be obtained.

Figure 3:
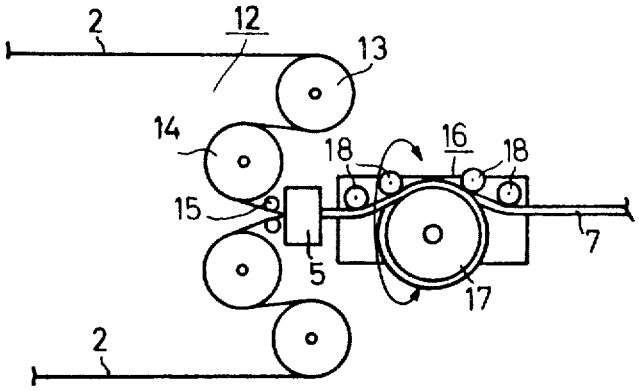
FIG. 3, illustrates another type of positive guide which can take up particularly large forces.

FIG. 3 shows a control guide 12 which can take up particularly large forces. For this purpose, two relatively large, profiled deflection pulleys 13 and 14 are provided which are arranged in tandem and over which a cable conductor is looped each time over an angle of about 180°. The distance between the running off point of a cable conductor at the second deflection pulley 14 and the twisting closer 5 is advantageously bridged by means of one or more profiled guide rollers 15. It is advisable in this connection to arrange the guide roller 15 in such a manner that the cable director is guided on a curved line on the way from the deflection pulley 14 to the twisting closer 5.

FIG. 3 shows at the same time a particularly advantageous embodiment of a twisting head 16 disposed after the twisting closer 5. The latter is constructed in the manner of a single pulley twister and consists of the deflection pulley 17 around which the material to be twisted 7 is looped once and have two pairs of two guide rollers 18, one for guiding material being fed in and the other material being taken off. While such a twisting head requires relatively large transverse dimensions depending on the diameter of the material to be twisted, speeds of rotation of the twisting head in the order of 25 to 50 rpm are obtained with a pull-off velocity of, say 40 to 75 m/min, taking into consideration a length of lay of about 1.5 m provided in the case of cable conductors with a conductor cross section of, for instance, 150 $mm^2$. The inertial forces of such a twisting head occurring during the twisting, however, are substantially smaller than in the case of conventional twisting head with revolving reels.

The profile of the deflection pulley 17, which may optionally also be designed as a pulling off pulley, is made slightly conical. The center of gravity of the deflection pulley 17 is preferably somewhat outside of the twisting axis.

Figure 4:
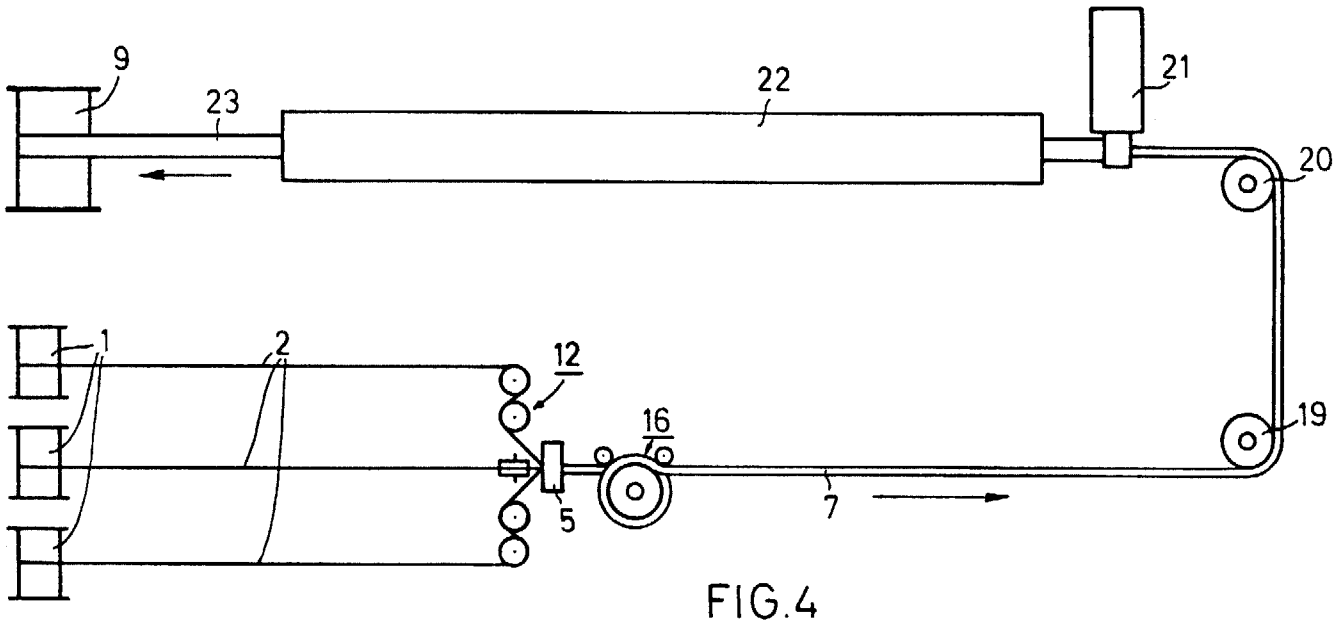
FIG. 4 illustrates twisting apparatus combined with an extrusion process for the twisted cable.

FIG. 4 shows an apparatus, in which the twisting of the cable conductors 2 to form a stranded assembly 7 is linked to an extrusion process for applying a cable jacket, and with which, therefore, a finished cable 23 can be manufactured from cable conductors 2. To this end, the twisting portion, which is in substance identical with the devices shown in FIG. 1 and FIG. 3, is followed by an extrusion line which is formed by an extruder 21 and a water cooling trough 22, which extends parallel to the twisting section and to which the stranded assembly 7 is fed via the deflection pulleys 19 and 20. As a modification of this embodiment, it is also possible to arrange the extruder 21 together with the water cooling section 22 after the twisting head 16 so that the water cooling section 22 provides the free distance for equalizing the torsions exerted by the twisting head 16 in the pull-off direction. It is further possible to combine the twisting of the cable conductors 2 with the process of insulating the conductors, by letting stranded conductors run off from the supply drums 1 and immediately jacketing these stranded conductors subsequently by means of an extruder and a water cooling section.

What is claimed is:

1. In apparatus for the SZ twisting of power cable conductors with a sector-shaped conductor section, which includes:

stationary conductor supplies;

a twisting closer with a control guide for each conductor arranged ahead thereof;

a twisting device rotating with alternating direction of rotation, and a pulling-off and take up device arranged after the twisting device, the improvement comprising:

(a) the distance between the engagement point of each control guide with a cable conductor and the first engagement point of the twisting device gripping the material to be twisted tensionally from the outside with the material to be twisted being small than, or at most equal to, the length of lay of the material to be twisted, given by the pull-off velocity and the speed of rotation of the twisting device, and being preferably smaller than, or at most equal to, one-half the length of lay; and (b) the free distance between the twisting device and the nearest device gripping the material to be twisted in the circumferential direction from the outside in a torsion proof manner being very much larger than the length by which a longitudinal section of the twisted material is advanced during an interval of constant direction of rotation of the twisting device.

2. The improvement according to claim 1, wherein each of said control guides comprises several profiled guide rollers arranged along a wavy line on the respective inside of the wavy line.

3. The improvement according to claim 2, wherein some of the guide rollers arranged on both sides of the wavy line are disposed opposite each other in pairs or in the gaps.

4. The improvement according to claim 1, wherein each of said control guides comprises two deflection pulleys on which the respective conductor makes contact with a looping angle of at least 90°.

5. The improvement according to claim 4, and further including one or more profiled guide rollers arranged between the second deflection pulley and the twisting closer.

6. The improvement according to claim 1 wherein the twisting device comprises a deflection pulley arranged approximately symmetrically to the twisting axis, over which the material to be twisted is looped once, and one or more guide rollers associated therewith for feeding in and taking off the material to be twisted.

* * * * *